United States Patent [19]

Rue

[11] 4,212,137

[45] Jul. 15, 1980

[54] SEGMENTAL GRINDING WHEEL AND COMPOSITE ABRADING SEGMENTS THEREFOR

[75] Inventor: Charles V. Rue, Petersham, Mass.

[73] Assignee: Norton Company, Worcester, Mass.

[21] Appl. No.: 926,539

[22] Filed: Jul. 20, 1978

[51] Int. Cl.[2] ..... B24D 5/08; B24D 7/06

[52] U.S. Cl. ..... 51/206.4; 51/209 R; 51/298; 51/307

[58] Field of Search ..... 51/298, 309, 295, 308, 51/204, 206.4, 209 R, 307

[56] References Cited

U.S. PATENT DOCUMENTS

| | | | |
|---|---|---|---|
| 1,868,492 | 7/1932 | Bucheister | 51/206.4 |
| 2,009,222 | 7/1935 | Connor | 51/209 |
| 2,023,041 | 12/1935 | Ballash et al. | 51/209 |
| 2,133,009 | 10/1938 | Ballash | 51/209 |
| 2,265,377 | 12/1941 | Kline | 51/209 |
| 2,467,094 | 4/1949 | Peden | 51/209 |
| 2,675,654 | 4/1954 | Harris | 51/204 |
| 2,749,682 | 6/1956 | Patrito | 51/204 |
| 2,797,537 | 7/1957 | Peden | 51/204 |
| 2,952,952 | 9/1960 | Stanhope | 51/204 |
| 3,869,834 | 3/1975 | Mullin | 51/295 |

FOREIGN PATENT DOCUMENTS

| | | | |
|---|---|---|---|
| 1482195 | 5/1967 | France | 51/209 |
| 300417 | 11/1928 | United Kingdom | 51/209 |
| 819330 | 9/1959 | United Kingdom | 51/209 |
| 1242267 | 8/1971 | United Kingdom | 51/295 |

*Primary Examiner*—Donald J. Arnold
*Attorney, Agent, or Firm*—Walter Fred

[57] ABSTRACT

A segmental grinding wheel includes abutting, interfitting and interchangeable composite abrading segments clamped to a rotary chuck, each of which comprises a preformed bonded abrasive segment of simple shape with at least a portion of each side, except a working face thereof, encased in a relatively non-abrasive precision molded plastic shell of precise dimensions, more complex and perfect interfitting configuration. The shell is preferably made of material that is or contains a grinding aid, prevents coolant swarf from filling the pores of the abrasive segment and reinforces the abrasive segment.

10 Claims, 7 Drawing Figures

SEGMENTAL GRINDING WHEEL AND COMPOSITE ABRADING SEGMENTS THEREFOR

TECHNICAL FIELD

The invention relates to segmental grinding wheels and particularly to composite interchangeable interfitting abrading segments therefor clamped to a chuck for rotation there with.

BACKGROUND ART

Segmental grinding wheels for a vertical spindle machine, such as the "Blanchard", are currently manufactured in various shapes and sizes. These generally fall into two widely used catergories, one of which includes abrasive segments which are angularly spaced and do not form a continuous annular grinding ring. The other type are abrasive segments which form a continuous annular grinding tool ring when mounted on a chuck, such as those known in the art as the "Sterling" interfitting shaped segments disclosed in U.S. Pat. Nos. 1,868,492; 2,023,041 and 2,133,009.

The "Sterling" shape segments form a continuous annular grinding ring by abutting its neighbor in a tongue and groove fashion. Usually, but not always, the inner concave side of the segment is coated with molten sulfur or other material to seal the abrasive surface and prevent coolant from flushing swarf into the pores of the segment.

The tongue and groove construction of the Sterling type segment is expensive to produce due to abrasive wear and cost of replacing the molds in order to maintain the precise shape.

Due to mold wear, curing or firing the size and shape of the segments vary enough to require hand fitting of segments to a chuck by means of rubbing down oversize segments or building up the abutting edge of undersize segments with sulfur or other type of paint or coating. For this reason they are usually sold in complete sets and not as individual segments.

However, the composite segment of the invention differs therefrom and is an improvement thereover in that it has an abrasive segment of more simplified arcuate shape, somewhat smaller in size and of less precise dimensions encased in a shell of relatively non-abrasive plastic material molded to precise dimensions and shape with perfectly interfitting tongue and groove sides.

The shell is formed around each individual preformed bonded abrasive segment by either injection molding, compression transfer molding or casting, in the conventional manner, a thermoplastic or thermosetting composition into the space between the precision mold surfaces and preferably all but the working abrasive surface of the simplified abrasive segment inserted therein.

Preferably, the material selected to form the shell is in itself a grinding aid or contains as much of any well known grinding aid filler material as is consistent with flowability and strength.

The composite segment of the invention has many advantages over its state of the art counterparts as follows:

1. The mold to produce the simplified bond abrasive segment need not be as precise, is less expensive to produce and can wear appreciably before it need be replaced.

2. No fitting of the composite segments is required since the exterior dimenions and shape are formed by a precise mold not subject to abrasive wear. Thus each segment is of such precise dimensions that duplication, mating engagement and interchangeability is assured.

3. The shell encasing all but the working surface of the composite segment prevents grinding swarf from filling the pores; and also reinforces the segment.

4. The shell contains and provides active filler or extreme pressure lubricant to aid the grinding process.

Applicant is aware of the prior art disclosing abrasive wheel segments and honing sticks coated with sulfur or cement, encased in metal, or plastic shells containing a filler, lubricant or grinding aid.

However, the encased abrasive segments or honing sticks do not have a precision molded plastic shell of a complex interfitting shape which can be consistently duplicated to the precise and exact dimensions. Thus, the interfitting segments of the invention are more uniform in size and shape than the "Sterling" type segments and therefore more readily interchangeable with one another.

DISCLOSURE OF THE INVENTION

A annular segmental grinding wheel having a plurality of interchangeable composite abrading segments preferably with interfitting tongue and groove like abutting side portions clamped to a rotatable chuck. Each composite segment comprising a preformed bonded abrasive segment of simple arcuate shape encased in a relatively non-abrasive precision molded shell of more complex shape covering at least a portion of each side except the working face of the abrasive segment of less consistent dimensions. On one end, the shell has a tongue or projection and on its opposite end a tongue or projection receiving depression, groove, slot, or recess molded to precise dimensions and shape for interfitting and abutting engagement with identical tongue and groove portions or adjoining composite segments in the segmental grinding wheel.

The shell is also provided with accurately molded convex, concave and top surfaces for precise mating, clamping engagement with the inner locating and retaining walls of the chuck and clamp means for securing the composite segments to the chuck.

Depending on the type of chuck and clamping means thereon, the composite segment may or may not be provided with a clearance slot for allowing the passage of a clamping screw for retaining the segment. The clearance slot, may be molded solely in a top portion of a plastic shell or in both the abrasive segment and the shell.

Therefore, it is the primary object of the invention to provide an annular segmental grinding wheel having a plurality of interchangeable, interfitting and abutting composite abrading segments of substantially identical precise dimensions and shape.

Another object is to provide composite segments for segmental grinding wheels each comprising a preformed bonded abrasive segment of simple shape encased in a relatively non-abrasive plastic shell molded to precise and more complex interfitting size and shape for mounting on a rotatable chuck.

A further object is to provide interchangeable composite abrading segments for segmental grinding wheels each having a relatively non-abrasive precision molded plastic shell of the desired precise interfitting complex size and shape made of material that is or contains a grinding aid encasing at least a portion of each side except the working face of a preformed bonded abrasive segment of simpler shape.

BEST MODE OF CARRYING OUT THE INVENTION

Figure 1:
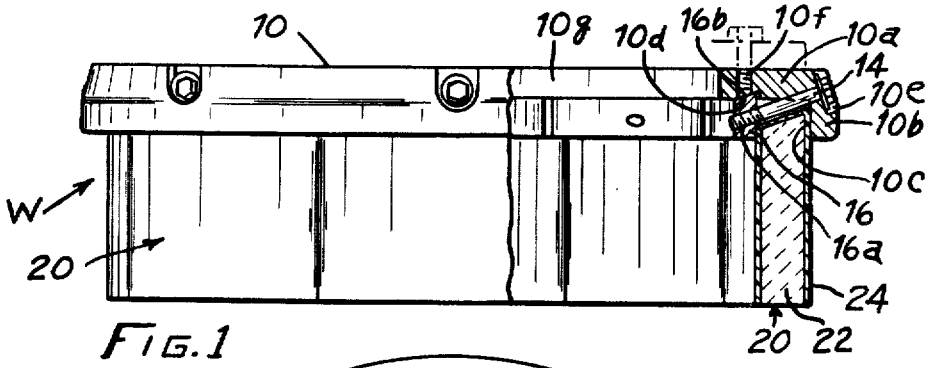
FIG. 1 is a side view, partly in section, of a segmental grinding wheel showing how the improved composite abrading segments constructed according to the invention may be attached to a rotary chuck.

Referring to the drawings, there is shown for illustrative purposes a segment grinding wheel W comprising a rotatable chuck 10 of the type disclosed in U.S. Pat. No. 2,023,041, to which reference may be had for details not disclosed herein, adapted to receive a continuous annular abrasive member or wheel composed of a plurality of interfitting and abutting "Sterling" type or shape abrasive segments.

The annular chuck or holder 10 has an inwardly extending body portion **10*a* and a lateral segment holding wall or flange 10*b* including an inner clamping surface 10*c* extending in this instance downwardly from and at right angles to the annular under surface of the body portion 10*a***.

Chuck 10 is also provided with an annular inclined tapered surface **10*d* on the underside portion 10*a* and similarly inclined or diagonally arranged circumferentially spaced U-shaped notched or counter bored holes 10*e* adapted for receiving clamping means. Angularly spaced screw threaded bolt holes 10*f* and a central bore 10*b* are provided for attaching the chuck 10** to the rotatable drive spindle or means of a suitable machine.

The clamping means on the chuck include a number of bolts 14 passing through the inclined holes **10*e* and threaded into arcuate clamping segments 16. Each clamping segment 16 has a threaded screw hole 16*a*, an upper inclined or tapered surface 16*b* in mating engagement with the similarly inclined surfaces 10*b* extending substantially parallel to the axis of the bolt holes and bolts 14 and a convex outer surface for mating clamping engagement with the inner concave surfaces of a composite abrading segment 20** of the continuous annular or cylindrical abrading or grinding portion of the segmental grinding wheel W.

Each composite abrading segment 20 of the wheel W comprises a preformed bonded abrasive segment 22 of relatively simple arcuate shape manufactured in the conventional manner well known to those skilled in the art. The abrasive segment 22 may include particles of any of the presently known abrasive material such as, emery, garnet, aluminum oxide, alumina-zirconia, natural or synthetic diamond, boron nitride, silicon nitride, silicon carbide, boron carbide and mixtures thereof. The abrasive particles may be organically bonded together with any suitable resinous or plastic material or inorganically bonded with metal or ceramic materials well known in the art.

Figure 3:
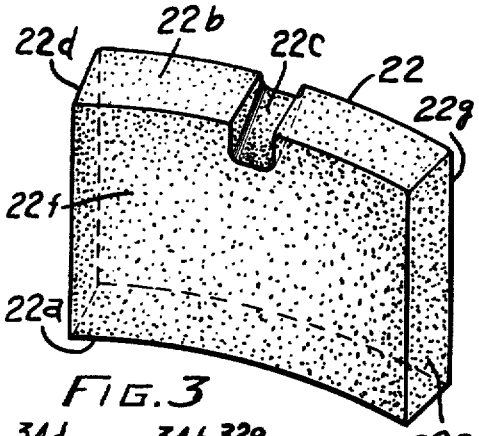
FIG. 3 is a perspective view of a preformed bonded abrasive segment of simple configuration before being encased in a non-abrasive precision molded plastic shell.

As shown in FIG. 3 the abrasive segment 22 is of a relatively simple rectangular arcuate shape defined by and including a flat working surface **22*a*, a flat top surface 22*b* interupted by a slot 22*c*, opposite end or side surfaces 22*d* and 22*e*, an inner concave surface 22*f* and outer convex surface 22*g*. Dimensional accuracy in the size and shape of the abrasive segment 22 is not as critical as one, such as the "Sterling" type, manufactured to fit directly into the chuck itself. Thus, more liberal tolerances and variations in the dimensional size and shape of the abrasive segment 22** are allowable reducing the rejection rate and cost of manufacturing the abrasive segment.

Figure 4:
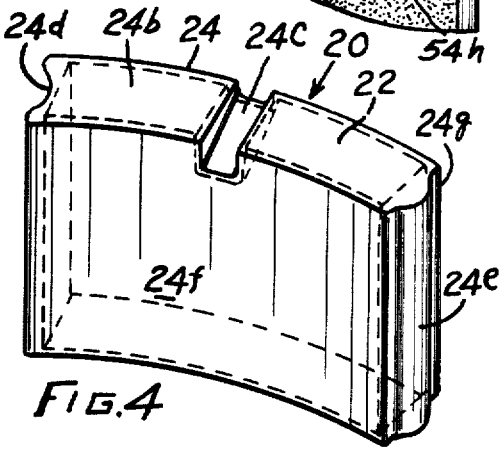
FIG. 4 is a perspective view showing the bonded abrasive segment shown in FIG. 3 encased in a plastic shell molded to a precise interfitting size and shape.

Referring to FIG. 4, the composite segment 20 comprises the abrasive segment 22 encased in a relatively non-abrasive molded plastic shell 24 of relatively more precise size and complex interfitting shape adapted to matingly engage the supporting wall surfaces of the chuck 10 and adjoining composite segments.

Figure 2:
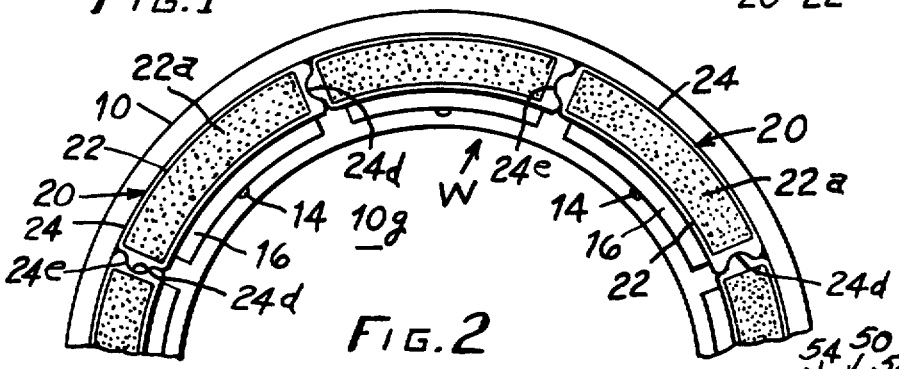
FIG. 2 is a partial bottom view of the segmental grinding wheel shown in FIG. 1.

As shown in FIGS. 1, 2 and 4 the shell 24 encases all but the working abrasive surface **22*a* of the abrasive segment 22**. Preferably, the plastic shell is injection molded or cast in the well known manner by supporting the abrasive segment in a mold cavity of the precise size and shape desired. Then, a suitable thermosplastic or thermosetting material in a flowable or liquid state is injected into the space remaining between the abrasive segment and the mold. Thereafter, the filled mold is cooled or heated to solidify the material conforming to the mold cavity.

Thus, the dimensional size and shape of the shell 24 and composite segment 20 can be held to much closer tolerances and therefor repeatedly duplicated with greater accuracy than a "Sterling" type abrasive segment of corresponding size and shape molded in the conventional manner. This is due to the fact that the non-abrasive plastic shell mold is not subjected to the great amount of abrasive wear as is a conventional mold.

The shell encasing the abrasive segment 22 has an integrally molded upper layer **24*b* extending continuously over the inclined bottom and sides of a clamping bolt clearance slot 24*c*. One side or end of the shell 24 has a layer with at least one groove, recess, or depression 24*d* of predetermined configuration. On its opposite side or end the shell has at least one tongue, projection, or protuberance 24*e* of a size and shape adapted to fit precisely into and engage the surface of the groove 24*d* in the shell 24 of an identical adjoining composite segment in the chuck 10. An inner concave layer 24*f* and an outer convex layer 24*g* extend between the opposite tongue and groove side layers 24*d* and 24*e* of the shell 24**.

Although, a preferred mating tongue and groove configuration has been shown, it is obvious that other equivalent mating, interfitting and/or interlocking arrangements may be provided.

As shown in FIGS. 1 and 2 the assembled interfitting segments 24 are interlocked together and individually clamped to the chuck 10 to provide a substantially continuous annular abrading member with an abrasive working surface interrupted by plastic shells 24 on opposite sides of each equally angularly spaced interfitting joint between the composite segments 20.

Each composite segment 20 is assembled and clamped to the chuck with its upper surface 24b engaging the annular under surface of the body portion 10a, its convex surface 24e contacting the mating inner concave surface 10c of the chuck 10 and its inner concave surface 24d engaged by the mating convex surface of the clamping segment 16. The initial composite segment 24 is clamped to the chuck 10 by aligning the slot 24 to clear the bolt 14 and tightening the bolt. The remaining segments are then assembled by aligning and inserting the tongue of one segment into the groove of another whereby the clearance slot 24c is automatically aligned with the clamping screw 14.

Each of the clamping bolts 14 draws the clamping segments 16 and its tapered surface 16b into engagement with and upwardly along the inclined annular surface 10d of the chuck 10. As the clamps 16 move along the incline they engage the upper arcuate portion of the shell 24 and force the segment 20 upwardly and outwardly into positive locating, mating and clamping engagement with surfaces of the chuck 10.

Figure 5:
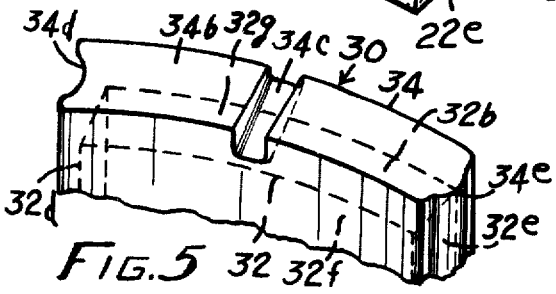
FIG. 5 is a partial perspective view of a modified form of the abrasive and composite segments shown in FIG. 3 and FIG. 4.
Figure 6:
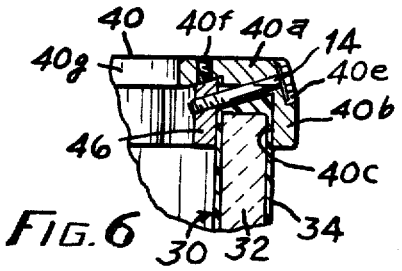
FIG. 6 is a partial sectional view of the chuck modified for attaching the composite segment shown in FIG. 5.

In FIG. 5 is shown another composite segment 30 which is a modified version of the composite segment 20 shown in FIG. 4. It differs therefrom in that it has an abrasive segment 32 of more simplified shape without a clamping bolt clearance slot and a molded plastic shell 34 with a thicker top or upper layer 24b and a clamping bolt clearance slot 34c molded therein. Thus, the top surface 32b of the encased abrasive segment 32 is situated further from the upper locating surface 34b of the shell 34 on the composite segment 30. This reduces the amount of clamping surface area and volume of the abrasive segment 34 if clamped between a clamping segment 16 and the surface 10e of the chuck 10 shown in FIG. 4. However, this can be compensated for in various ways, one of which is to provide a chuck 40 partly shown in FIG. 6.

Chuck 40 is a slightly modified version of the chuck 10, that will accept either of the composite segments 20 or 30. The chuck 40 differs solely from chuck 10 in that the downwardly extending flange with an inner clamping surface 40c and the clamping segment 46 have a greater axial width than the flange 10e and clamping segments 16 of the chuck 10.

Another chuck on which either the composite segments 20 or 30 may be mounted is disclosed in U.S. Pat. No. 2,133,009.

Various thermoplastic and thermosetting compositions, plastic materials and resins may be used in conjunction with suitable conventional injection or transfer compression molding or casting apparatus to mold or cast the complex shells about the abrasive segments of simpler shape. Suitable thermoplastics are polyvinyl chloride, polyvinylidene chloride, acrylonitrile-butadiene-styrene (ABS), acrylics, acetals, polyamides, polyamid-imides, polystyrene, phenoxies, cellulose acetate butyrate, cellulose acetate propionate, fluorinated ethylene propylene, polyvinylidene fluoride, nylons, phenylene oxides, polysulfones, polybutadienes, polybutylenes, polycarbonates, polymethyl pentene, thermoplastic polyesters, polyethylenes, polyproplene, polyphenylene sulfide, polyether sulfone, sulfur plus filler material, and mixtures thereof. Thermosetting materials such as phenolics, epoxies, thermosetting polyesters, alkyds, ureas, melamines, diallyl phthalate, polyurethane, silicones and mixtures thereof may be used as well.

Preferably, the material or composition of which the shell is molded or cast is itself a grinding aid or contains as much of any known grinding aid type filler as is consistent to maintain flowability and strength thereof. Such known grinding aid materials include iron pyrites, sulfur, metal sulfides, cryolite, potassium fluoborate ($KFB_4$), potassium sulfate ($K2SO_4$), extreme pressure lubricant type materials such as graphite, molybdenum disulfide, polytetrafluoroethylene, polyfluorinated ethylene propylene, polyphenylene sulfide, polyvinyl fluoride, polyvinyl chloride and mixtures thereof.

The materials or composition of the shell may also contain modifiers such as colorizers, fire retardants, reinforcing fibers, active or inactive fillers and other additives to produce alloys thereof with exceptional physical and chemical qualities.

Hence, during grinding the jacket or shell material simultaneously wears to enhance the abrading process. Also, the remaining side portions prevent absorption of coolant swarf into the abrasive segments and reinforce the abrasive segments against breakage and chipping at the edges thereof.

Producing a typical composite abrading segment of the invention similar to the "Sterling" type includes conventionally molding an abrasive composition containing abrasive particles such as aluminum oxide of the desired grit size, say 30 grit, and a conventional vitrifiable bond composition containing glass into a self supporting green abrasive segment of smaller size and of simpler arcuate shape than the desired "Sterling" type segment. The green segment is then fired in a kiln, cooled and removed therefrom in the well known manner. Each vitrified bonded segment is then cleaned of foreign matter, placed into and held centered in a molded cavity of the desired finished size and shape of the "Sterling" type segment. A thermoplastic grinding aid material such as polyvinyl chloride on sulfur reinforced with glass fibers and wallastonite fillers, heated to maintain it in a flowable state, is then injected in the usual manner into the mold cavity until the space between the abrasive segment and mold is filled. The mold is then cooled, to solidify the material, opened and the composite segment with a shell of specified thickness molded to the precise interfitting size and shape is removed therefrom.

When the shell is made of a thermosetting material, the material preferably contains a grinding aid filler and is usually preheated to a more flowable uncured state before it is rammed into the mold cavity between the abrasive segment and a heated mold. Thus, the thermosetting material forced into the mold is heated thereby to a permanently hardened shell of precise complex shape about the abrasive segment of simpler shape. Each composite segment as molded is ready for immediate interfitting supporting engagement with other identically molded composite segments of a segmental wheel and the mating, supporting and clamping surfaces of the chuck and clamping means.

The thickness of the shell about the abrasive segments of less precise dimensions and simpler shape may vary between composite segments and at different locations on each composite segment. Obviously, the interfitting tongue and groove like layers must be thicker at some point than the layers encasing the top, concave and convex sides of the abrasive segment. However, the shell should be at least thick enough so that its exterior surof precision size and shape extends at least to but preferably from 1 mm to 5 mm beyond the outermost points of the outermost abrasive particles in each encased surface of the abrasive segment.

Figure 7:
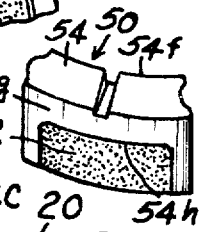
FIG. 7 is a sealed down perspective view of another composite segment with a modified shell.

Obviously, the lower central portions of the concave and convex side layers of the shell extending beyond the chuck and consumed during grinding need not be of the same thickness as portions thereof for clamping mating engagement with the chuck. One or both of the lower central portions could be much thinner or eliminated as shown in FIG. 7 whereby the shell would have either a recessed surface or an opening in one or both of the concave and convex layers. Thus, the recessed surface or opening would extend between adjacent side portions of the tongue and groove and from adjacent a top portion engaging the chuck to the working surface of the abrasive segment.

As shown in FIG. 7, a composite segment 50 has a preformed bonded abrasive segment 52 and a shell 54 with an opening **54*h* in either or both the lower central portions of the concave and outer convex walls 54*f* and 54*g*. An opening in each of the walls provides an inverted U-shape shell with top and side U-shape channel portions adjacent the tongue, groove and top portions of the shell encasing the opposite side and top portions of the abrasive segment 52. Hence, the composite segment 50 has a molded plastic shell 54 of precise interfitting size and shape encasing at least a portion of all sides except the working face of the abrasive segment 52**. It is also adequate to provide enough grinding aid to enhance the grinding process, for clamping engagement with the chuck and precise interfitting engagement with adjacent segments of the wheel. However, the lower central portion of one or both of the concave and convex abrasive surfaces of abrasive segments would be exposed to coolant swarf which, depending on the grinding application, may be tolerated.

As many modifications and embodiments of the invention are possible, it is to be understood that the invention is not limited to the specific embodiments disclosed hereinabove, but includes all modifications, embodiments, and equivalents structured falling within the scope of the appended claims.

What is claimed is:

1. A composite abrading segment of precise size and interfitting arcuate shape for an annular segmental grinding wheel wherein a plurality of segments are assembled in interfitting engagement with each other and clamping to suitable chuck means adapted for mounting on drive means for rotation therewith about an axis comprising:

a preformed bonded abrasive segment of simple arcuate shape having a working face; and a shell of precise size and more complex interfitting arcuate shape encasing at least a portion of each side except the working face of the abrasive segment and having at least one projection on an end of the shell adapted for interfitting engagement with a depression on an adjoining segment of the grinding wheel, and at least one depression on an opposite end of the shell adapted for receiving a projection on another adjoining segment of the grinding wheel.

2. A composite abrading segment according to claim 1 wherein the projection on an end of the shell is a tongue and the depression on the opposite end of the shell is a groove into which a tongue of an adjoining segment is inserted.

3. A composite abrading segment according to claim 1 wherein the shell further comprises:

a grinding aid.

4. A composite abrading segment according to claim 1 wherein the shell is made of polyvinyl chloride which constitutes a grinding aid.

5. A composite abrading segment according to claim 1 wherein the shell is made of thermoplastic or thermosetting material containing at least one active filler selected from a group consisting of iron pyrites, sulfur, potassium sulfate, cryolite and potassium fluorborate.

6. A composite abrading segment according to claim 1 wherein the shell is made of sulfur containing at least one filler material.

7. A composite abrading segment according to claim 7 wherein the shell is made of a thermoplastic or thermosetting material containing at least one extreme pressure lubricant selected from a group consisting of graphite molybdenum disulfide and polytetrafluoroethylene.

8. A composite abrading segment according to claim 1 further comprising:

a slot of predetermined depth and width extending downwardly into the abrasive segment from a top side and between an inner side and an outer side of the shell.

9. A composite abrading segment according to claim 1 wherein the shell further comprises:

a top layer, including a slot of predetermined width and depth therein, extending at least the depth of the slot over at least a portion of an adjoining top surface of the abrasive segment.

10. A composite abrading segment of precise size and interfitting arcuate shape for an annular segmental grinding wheel wherein a plurality of segments are assembled in interfitting engagement with each other and clamped to suitable chuck means adapted for mounting on drive means for rotation therewith about an axis comprising:

a bonded abrasive segment of simple shape having a working face; and a shell of precise size and interfitting arcuate shape encasing at least a portion of each side except the working face of the abrasive segment and having opposite end portions of the shell each adapted for interfitting engagement with an end portion of an adjoining segment of the grinding wheel.

* * * * *